US006681689B2

(12) United States Patent
Geiser

(10) Patent No.: US 6,681,689 B2
(45) Date of Patent: Jan. 27, 2004

(54) ROLL BALER

(75) Inventor: Jens Geiser, Dettum (DE)

(73) Assignee: Lely Maschinenfabrik GmbH, Wolfenbüttel (DE)

( * ) Notice: Subject to any disclaimer, the term of this patent is extended or adjusted under 35 U.S.C. 154(b) by 0 days.

(21) Appl. No.: 10/138,347

(22) Filed: May 3, 2002

(65) Prior Publication Data

US 2003/0024406 A1 Feb. 6, 2003

(30) Foreign Application Priority Data

May 4, 2001 (DE) ..... 101 21 831

(51) Int. Cl.[7] ..... B30B 5/06
(52) U.S. Cl. ..... 100/88; 100/87; 56/341
(58) Field of Search ..... 100/3, 5, 8, 76, 100/87, 88, 15; 56/341, 342, 343

(56) References Cited

U.S. PATENT DOCUMENTS 4,457,226 A * 7/1984 Meiers ..... 100/5
4,530,279 A * 7/1985 Walker ..... 100/5
4,647,243 A * 3/1987 Koning ..... 403/61
4,715,175 A * 12/1987 Schaible et al. ..... 56/432
5,054,387 A * 10/1991 Diederich et al. ..... 100/5
5,349,806 A * 9/1994 Swearingen et al. ..... 56/341

* cited by examiner

*Primary Examiner*—Allen Ostrager
*Assistant Examiner*—Shelley Self
(74) *Attorney, Agent, or Firm*—Sidley Austin Brown & Wood, LLP

(57) ABSTRACT

A roll baler including circumferentially rotatable conveyor elements limiting a compression space therebetween, and a device for wrapping up a roll bale, which is formed in the compression space, with a section of a sheath web, the wrapping-up device including a pivotable start-up element for pressing the sheath web, against a surface of one of the rotatable conveyor elements, a separation element for cutting the sheath web off after the wrapping-up process ends and pivotable between cutting and non-cutting positions, and a common pivot axle for supporting the start-up element and separation element for pivotal movement.

11 Claims, 2 Drawing Sheets

ROLL BALER

BACKGROUND OF THE INVENTION

1. Field of the Invention

The present invention relates to a roll baler including circumferentially rotatable conveyor elements limiting a compression space therebetween, and a device for wrapping up a roll bale, which is formed in the compression space, with a section of a sheath web, the wrapping-up device including pivotable start-up means for pressing the sheath web, at least in an initial phase of a wrapping-up process, against a surface of one of the rotatable conveyor elements and separation means for cutting the sheath web off after the wrapping-up process ends and pivotable between cutting and non-cutting positions.

2. Description of the Prior Art

A roll baler of the type described above is disclosed in German Utility Model DE 296 12 863 UI. In the roll baler of this utility model, a sheath web is pressed by a pressure element against a side of a conveyor band remote from the compression space. The sheath web is delivered into the pressure space through an admission gap by a 180° deflection element. The drawback of such deflection of the sheath web, in particular with a conveyor bank having a specific texture, consists in that the sheath web is not always entrained by the belt. The separation device is supported on a second axle offset with respect to the pivot axle of the pressure element, and is connected mechanically with the pressure element. For cutting off the sheath web, the separation device should be pivoted over a relatively large arc over the pressure element and into a V-shaped guide of the pressure element. With such an arrangement many parts become necessary, on the one hand, and, on the other hand, the separation device requires a relatively large space for its installation and operation. However, the main drawback of the known device consists in an unreliable cut-off of the sheath web due to the fact that the sheath web and the separation device move both in the same direction. As a result, no definite edge of a cut can be produced. This results in that a poorly cut sheath web is partially taken up the separation device and/or is only partially removed from the conveyor band. In addition, a poor cut makes the introduction of the sheath web into the compression space more difficult.

Accordingly, an object of the present invention is to eliminate the above-discussed drawbacks of the wrapping-up means of the prior art roll baler.

SUMMARY OF THE INVENTION

This and other objects of the present invention, which will become apparent hereinafter, are achieved by mounting both the pressure element and the separation device on the same axle. In this way, the functions of starting the delivery of the sheath web and separation of the sheath web by pivoting the start-up device in one direction and the separation device in another, opposite direction are realized unexpectedly easily. This, in case an automatic control is used, permits to effect both functions with a single drive. In addition, the cutting direction of the separation device can be so selected that it would insure a good cut. Both the start-up device and the separation device have a simple construction, small dimensions, are reliable, substantially wear-free, require little maintenance, and are economical in manufacturing.

A common adjustment of both the start-up device and the separation device permits to provide a particularly simply, reliable and economical construction.

According to a preferred embodiment of the present invention, both the start-up device and the separation device are arranged in a common, pivotally supported frame. This permits to obtain a compact, rigid unit.

A particular reliable arrangement is obtained when the distance between the separation device and the pivot axle is smaller than a distance between the pivot axle and the start-up device, and the pivoting or drive means is connected with at least one of the pivot arms in which the pivot axle is supported. This arrangement, on one hand, provides for a sufficiently large distance between the band and the start-up device which permits the sheath web to be freely suspended in the intermediate space, preventing inadvertent entraining of the sheath web. On the other hand, the pivotal movement of the separation device is relatively small, with the pre-stressed sheath web having already passed past the separation device relatively far into the compression space. Furthermore, a direct drive is insured by connecting the drive means with one of the pivot axle-supporting arms.

In a further preferred embodiment of the present invention, the start-up device has a freely rotatable pressure roll. The pressure roll presses the sheath web against the conveyor band at least at the start of wrapping-up process and is rotated by the web. Then, the pressure roll pivots into the intermediate neutral position, and the formed roll bale pulls the sheath band directly from the supply roll.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 2:
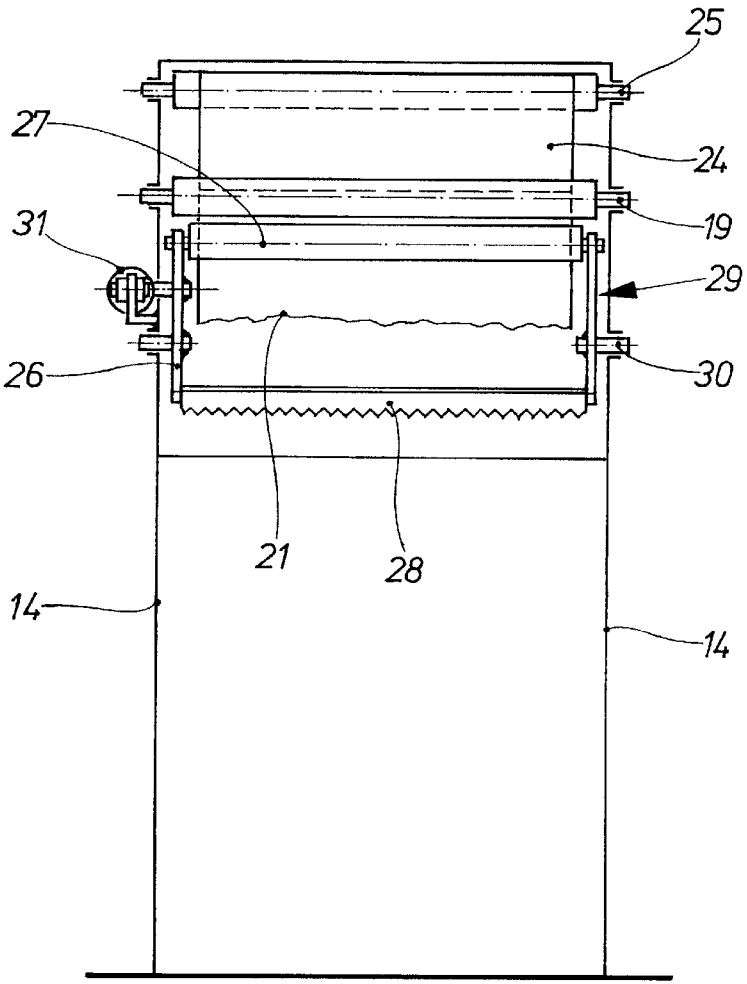
FIG. 2 a front view of the roll baler shown in FIG. 1.

The roll baler, which is shown in the drawings, essentially includes a housing 1 having a compression space 2 which is defined by two conveyor band segments 3 and 4. Between the conveyor band sections 3, 4, there is provided an admission gap 5 through which a to-be-compressed material is admitted from a feed chamber 6 above the feed table 7. One of the conveyor band segments 3, 4, namely, the segment 3 is located in a stationary housing port 8 and is supported by deflection and/or drive rollers 9. The conveyor band segment 3 has a band section 10 which extends so far above the admission gap 5 that it forms a wall of the feed chamber 6. The second conveyor band segment 4 is located in a housing part 13 foldable about an upper pivot axle 11 into a bale discharge position.

The housing 1 is limited, in the axial direction of the compression space 2, by two side walls 14 which are spaced from each other by a distance corresponding to the width of the compression space 2. The housing 1 is further limited by a rear wall 15 and by an upper cover 16.

The housing 1 is further provided with a front wall 17. Above the admission gap 5, there is provided a wrapping-up device 18. The wrapping-up device essentially includes a supply roller 20, which is supported by support rollers 19, a start-up device 22, and a separation device 23. The supply roller 20 carries a sheath web 21, e.g., a net or foil. The start-up device 22 provides for take-off of the sheath web 21, and the separation device 23 cuts the sheath web 21 after a predetermined amount has been wound down.

The support rollers 19 and the supply roller 20 are supported for rotation in the side walls 14 but remain stationary during operation of the baler. A sheath web section 24, after being pulled from the supply roller 20, runs substantially horizontally toward a deflection roller 25 and hangs therefrom after being deflected by 90°, substantially vertically downward at a distance from the conveyor band section 10. The start-up device 22 and the separation device 23 are arranged on the opposite, with respect to the band section 10, sides of the suspended section of the pulled-out sheath web 21 at a distance therefrom.

The start-up device 22 includes a pressure roll 27 which is rotatably supported in a pivot arms 26 and which extends essentially over the entire width of the compression space 2. A cutting blade 28, which forms the separation device 23, is secured in the pivot arms 26 opposite the pressure roll 27. The pressure roll 27, the pivot arms 26, and the cutting blade 28 form a rigid, rectangular frame 29 that is pivotably supported in the side walls 14 by a stationary axle 30. The lever arm between the cutting blade 28 and the axle 30 is smaller than a lever arm between the axle 30 and the pressure roll 27. A servo drive 31 is provided between the axle 30 and the pressure roll 27. The servo drive 31 is connected to the side wall 14 at one of its ends and is connected, at its opposite end, to a pivot arm 26. The servo drive 31 can be formed as an electric linear motor or as a hydraulic cylinder.

The start-up and separation devices 22, 23 operate as follows.

After a bale reaches a predetermined diameter, the frame 29 is pivoted, manually or by the servo drive 31 in a direction indicated by the arrow 32 into a start position shown in dash lines in which the pressure roll 27 presses the sheath web 21 against the band section 10 with a predetermined pressure. The band section 10, which runs in the direction indicated by arrow 34 and is frictionally engaged with the sheath web 21, carries the sheath web 21 through the admission gap 5 into compression space 2. The servo drive 31, which is time and space controlled, displaces the frame 29, together with the cutting blade 28 and the pressure roll 27, into a neutral position 35 shown in full lines, in which both the pressure roll 27 and the cutting blade 28 are inactive. In this position of the frame 29, the rotatable, in the compression space 2, roll bale pulls the sheath web 21 from the supply roller 20. After reaching the desired degree of wrap-up, e.g., after three revolutions, the servo drive 31 displaces the frame 29 into its cutting position 36 shown in dash lines. In this position of the frame 29, the cutting blade 28 is brought into engagement with the still running, sheath web 21 and cuts it off. Then, the servo drive 31 again pivots the frame 29, together with the pressure roll 27 and the cutting blade 28 into the middle or neutral position 35. After folding of the housing part 13, the wrapped-up roll bale is expelled out of the compression space 2, and a new cycle can begin.

Figure 1:
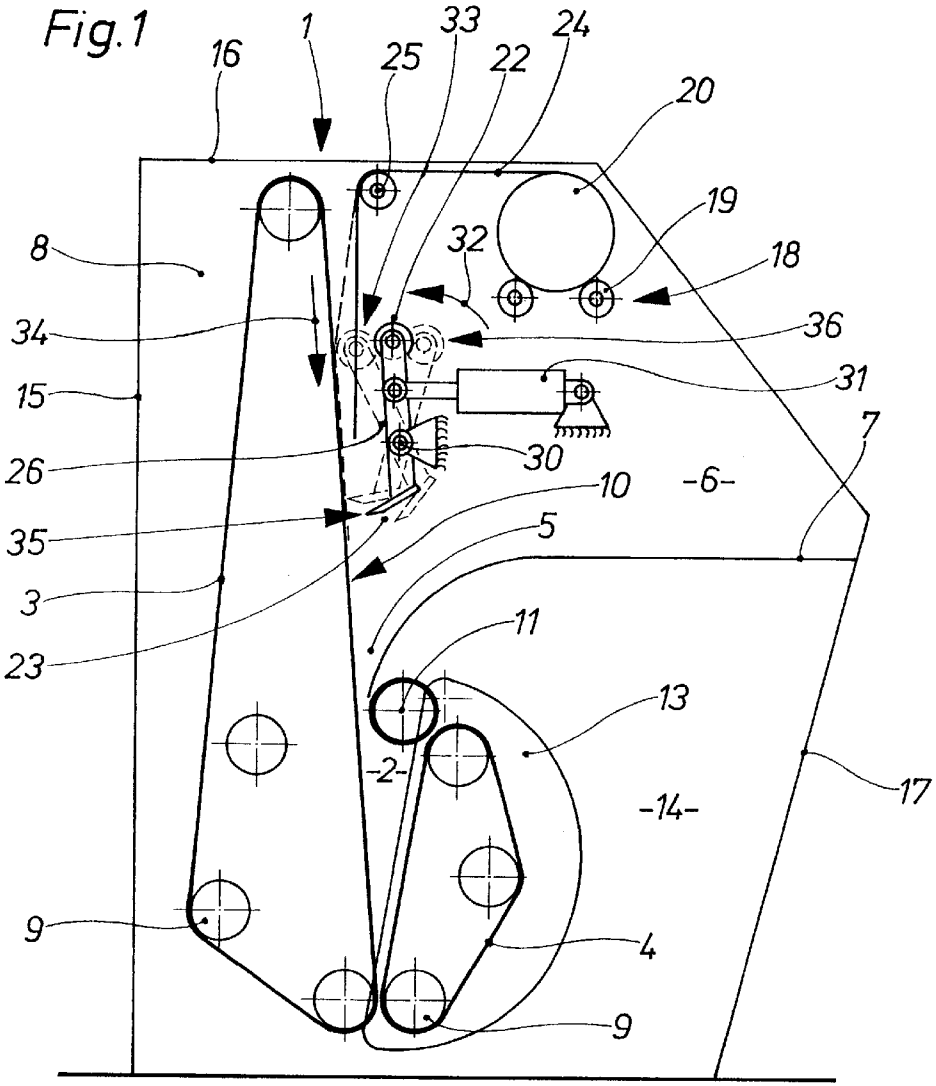
FIG. 1 a side view of a roll baler with start-up and separation devices according to the present invention.
Figure 3:
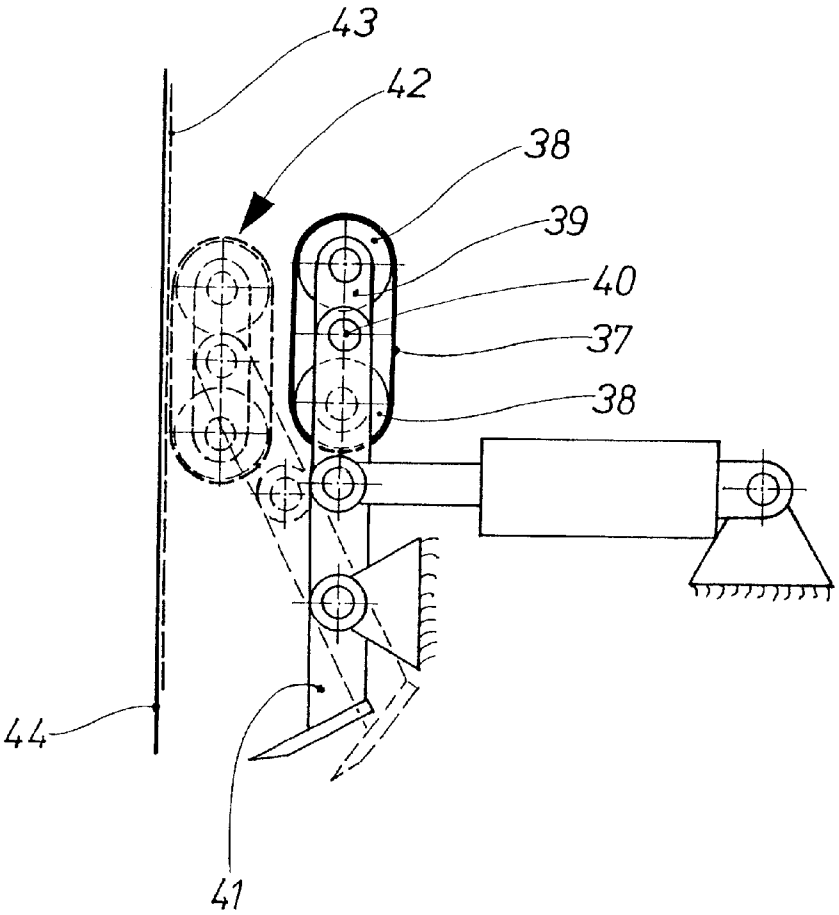
FIG. 3 a side view of an alternative embodiment of a pressure element in form of a conveyor band.

In the embodiment shown in FIG. 3, instead of a pressure roll 27, a conveyor band 37 supported by two deflection rollers 38 is used. The deflection rollers 38 are supported by a support element 39 which is supported in pivot arms 41 for pivotal movement about an axle 40. The start position 42 of this arrangement is shown in dash lines. The advantage of the arrangement shown in FIG. 3 consists in that it insures a reliable entraining of the sheath web 43 as it provides for a large-surface contact of the web 43 with the conveyor band section 44. The arrangement shown in FIG. 3 operates in the same manner as that shown in FIGS. 1–2.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A roll baler, comprising circumferentially rotatable conveyor elements limiting a compression space therebetween; and a device for wrapping up a roll bale, which is formed in the compression space, with a section of a sheath web, the wrapping-up device including pivotable start-up means for pressing the sheath web, at least in an initial phase of a wrapping-up process, against a surface of one of the compression space-limiting, rotatable conveyor elements; separation means for cutting the sheath web off after the wrapping-up process ends and pivotable between cutting and non-cutting positions, and a common pivot axle for supporting the start-up means and separation means for pivotal movement, wherein the wrapping-up device comprises means for simultaneously pivoting the start-up means and the separation means.

2. A roll baler as set forth in claim 1, wherein the simultaneously pivoting means comprises a pivotally supported frame.

3. A roll baler as set forth in claim 2, further comprising means for pivoting the frame between start-up and cutting-off positions.

4. A roll baler as set forth in claim 3, wherein the frame comprises side, stationary, with respect to the frame, pivot arms fixedly secured to the frame for joint pivotal movement therewith, with the start-up means and the separation means being supported at opposite free ends of the pivot arms, respectively.

5. A roll baler as set forth in claim 1, wherein the start-up and separation means are manually pivoted.

6. A roll baler as set forth in claim 1, further comprising drive means for pivoting the start-up and separation means.

7. A roll baler as set forth in claim 4, wherein the common pivot axle is supported in the pivot arms, wherein a distance between the separation means and the pivot axle is smaller than a distance between the start-up means and the pivot axle, and wherein the frame-pivoting means is connected with at least one of the pivot arms.

8. A roll baler as set forth in claim 1, wherein the start-up means comprises a freely rotatable pressure roll.

9. A roll baler as set forth in claim 1, wherein the start-up device comprises a conveyor band.

10. A roll baler as set forth in claim 4, wherein the separation means comprises a cutting blade.

11. A roll baler as set forth in claim 1, wherein the wrapping-up device further includes a supply roller for supporting the sheath web, and wherein the wrapping-up device is located above an admission gap through which to-be-compressed goods are delivered into the compression space by the one of the conveyor elements, which extends above the admission gap and run in a direction of the admission gap, the start-up means comprising an element for pressing the sheath web that is wound down from the supply roller against the one of the conveyor elements, whereby the sheath web is delivered in the compression space by the one of the conveyor elements.

* * * * *